US005249736A

United States Patent [19]

Eisman

[11] Patent Number: 5,249,736

[45] Date of Patent: Oct. 5, 1993

[54] FOOD CARTON WITH COVER

[75] Inventor: Larry Eisman, Downingtown, Pa.

[73] Assignee: Dopaco, Inc., Downingtown, Pa.

[21] Appl. No.: 866,508

[22] Filed: Apr. 10, 1992

Related U.S. Application Data

[63] Continuation-in-part of Ser. No. 833,114, Feb. 10, 1992, Pat. No. 5,188,284.

[51] Int. Cl.[5] ..... B65D 5/28

[52] U.S. Cl. ..... 229/110; 229/114; 229/146; 229/148; 229/902

[58] Field of Search ..... 229/109, 110, 112–114, 229/125.27, 125.29, 146, 148, 150, 178, 901, 902, 906

[56] References Cited

U.S. PATENT DOCUMENTS

| | | | |
|---|---|---|---|
| 2,925,213 | 2/1960 | Zukoski | 229/109 |
| 3,027,062 | 3/1962 | Huss et al. | 229/114 |
| 3,410,475 | 11/1968 | Wagner | 229/178 |
| 4,620,666 | 11/1986 | Lacasa et al. | 229/110 |
| 4,809,908 | 3/1989 | Keefe et al. | 229/150 |
| 4,856,707 | 8/1989 | Lorenz | 229/114 |
| 4,877,178 | 10/1989 | Eisman | 229/114 |
| 4,930,681 | 6/1990 | Fultz et al. | 229/906 |
| 5,037,026 | 8/1991 | Hanko | 229/114 |
| 5,118,032 | 6/1992 | Geho | 229/110 |
| 5,160,081 | 11/1992 | Beales | 229/114 |

FOREIGN PATENT DOCUMENTS

| | | | |
|---|---|---|---|
| 2652566 | 4/1991 | France | 229/125.29 |

*Primary Examiner*—Gary E. Elkins

*Attorney, Agent, or Firm*—Dennison, Meserole, Pollack & Scheiner

[57] ABSTRACT

A clam-shell carton having a hexagonal tray with a similarly configured hexagonal cover integrally hinged thereto. The tray and cover, outward of hinge joined inner walls thereof, include alternating high and low peripheral walls with projecting locking lugs on selected ends of the high walls. The high and low walls on the cover respectively overlap the low and high walls on the tray with the locking lugs on the cover releasably interlocking with the locking lugs on the tray.

13 Claims, 3 Drawing Sheets

FOOD CARTON WITH COVER

This is a continuation in part of Application Ser. No. 07/833,114, filed Feb. 10, 1992, for CARTON WITH LUG LOCKED TRAY AND COVER, now U.S. Pat. No. 5,188,284 issued Feb. 23, 1993.

BACKGROUND OF THE INVENTION

Principal goals for cartons or containers used in the fast food industry wherein only a single use is contemplated include the formation of cartons to both properly accommodate the foodstuffs, and to in themselves be an economical and practical product.

As such, the carton, when open, must be able to allow for quick and easy introduction of the food product. The carton must also be able to both close and lock in a positive manner, and easily open for access to the carton contents Another desirable feature, particularly in preassembled fast food cartons folded from blanks of paperboard or the like, is the capability for a compact nesting of the cartons for storage and shipment. As an example of cartons incorporating the above features, attention is directed to applicant's prior U.S. Pat. No. 4,877,178, issued Oct. 31, 1989.

Two part cartons, for example the hinged carton of the above patent, normally provide for an interlock between the tray and overlying cover by utilizing complementary although different interlocking means, usually projections or tabs on one component and tab receiving recesses, slits or notches on the companion component.

The provision of two distinct locking elements on the tray and cover of a carton, wherein selected ones of the locking elements include internal cuts or openings in a blank as opposed to locking tabs or the like defined along the edge of the blank, require a rather elaborate die construction to form and properly position the internal cuts.

The conventional use of internal slits, notches or openings as an element of the locking means between the tray and cover also gives rise to other potential problems. Such openings, not only weaken the material and affect the structural stability of the formed carton, providing potential tear areas, but also tend to interrupt areas on which printed copy or indicia appears. Further, the actual formation of such openings and the removal of the cut material from the interior of the blank either at the time of forming or as the carton is put into use, introduce additional manufacturing complexities.

While cartons for fast food and the like are provided in a variety of sizes to generally correspond with the foodstuffs to be received therein, such cartons are conventionally of rectangular configuration and without regard to the specific shape of the goods to be received. For example, notwithstanding that the conventional pizza is circular, the conventional pizza box is square. In such situations, there is wasted space within the carton and the use of excess paperboard or the like in the formation of the "oversized" carton.

SUMMARY OF THE INVENTION

The carton of the present invention is a two component carton comprising a tray with a cover hinged thereto for selective movement between an open position outward of the tray and a closed position overlying and locked to the tray.

A principal object of the invention is the provision of a carton which is particularly adapted to accommodate circular pizza pies and the like in a secure and protective manner without excess or unnecessary internal space, thereby minimizing the amount of material required as well as the physical bulk of the carton.

Related objects include the provision of a carton which, while formed of conventional paperboard material, provides enhanced strength, structural stability and, through the elimination of excess internal volume, an increased ability to retain heat.

Further objects of the invention include the provision of a tray and cover relationship wherein, in the closed carton, there is a peripheral overlap and multiple readily engaged and disengaged positive locks to effectively retain and protect the received product, while allowing for ready access thereto. The locking system is such as to require no apertures through either the tray or cover, thus avoiding disruptions in the exterior surfaces thereof and eliminating any possible areas of weakness both in the structural integrity of the carton and in the closed interior thereof.

Basically, the carton of the invention is of the type commonly referred to as a clam shell carton wherein the tray and cover are integrally hinged along a common edge for a selective movement of the cover between a position outwardly pivoted from the tray and a closed position overlying and engaged with the tray.

The tray and cover each include a base panel and integral vertically extending walls peripherally thereabout. The walls are generally planar and oriented at included obtuse angles to the adjacent walls to define a generally circular enclosure as opposed to the more conventional rectangular box. In the preferred embodiment, both the tray and cover will be of hexagonal configuration with six generally equal length walls edge joined to define six internal corners of 120°.

The tray and cover both have low inner walls integrally joined along a common top edge thereof to define a hinge therebetween. One of either the tray component or the cover component includes a pair of low walls extending outward from the inner wall at the opposed ends thereof at obtuse angles. A pair of high walls extend outward from the outer ends of the low walls, also at obtuse angles thereto, and in turn have the outer ends thereof joined by an outermost low wall. Each of the high walls includes a coplanar tab at each end thereof above and extending beyond the adjacent low wall.

The second component of the tray and cover components has a pair of high walls extending outward and at obtuse angles from the opposed ends of the corresponding low inner wall. The outer ends of these high walls in turn join, at obtuse angles, to a pair of outwardly extending low walls, the outer ends of which are joined by a high wall. Each end of the second component high walls, other than for the ends joined to the inner hinged low wall include coplanar projecting tabs above and extending across the opposed ends of the corresponding low walls. As will be recognized, other than for the hinge joined inner walls, the alternating arrangement of the low and high walls of the tray and cover components are opposite each other whereby upon a closure of the cover over the tray, each low wall will align with and be overlapped by a high wall. All of the walls are slightly outwardly tapered so as to simplify the overlapping engagement thereof, and to allow for compact nesting of the empty cartons.

The projecting tabs, upon a closing of the cover and through a slight flexing of the tabs or walls, snap-lock into engagement with each other, providing a visual indication of a proper locking of the cover to the tray. Disengagement of the cover from the tray is easily effected in an obvious manner by outwardly flexing selected ones of the outermost cover walls.

The hexagonal configuration illustrated is preferred as an effective means to closely approximate the circular configuration of a pizza and thus reduce the material required for the carton, the size of the carton and unneeded interior space However, other polygonal configurations of greater than four sides, utilizing obtuse angles, and following a generally circular layout might be considered.

It will be noted that the length of the individual sides of the hexagonal carton are relatively shorter than the sides of a conventional rectangular pizza box of a size necessary to contain a predetermined size pizza. As such, both the walls themselves and the overall carton, for the same thickness of paperboard material or the like, will be inherently stronger and afford greater protection to the product therein. Also, while the above described polygonal configuration of the carton rather closely conforms to the circular configuration of a pizza, actual engagement, assuming a pizza of a size substantially equal to the interior of the carton, will be at intermediate portions of the walls as opposed to full edge to wall contact as might occur in a completely circular carton. As such, the pizza will be largely cushioned against any damage resulting from an inward crushing of the carton edge.

A further possible benefit residing in the hexagonal configuration of the tray is the possibility of utilization of the opposed angles as a guide for the cutting of the pizza into triangular pieces for serving.

Additional objects and advantages of the invention are considered to reside in the details of construction as will be more fully hereinafter presented.

DESCRIPTION OF PREFERRED EMBODIMENTS

Figures 1, 4:
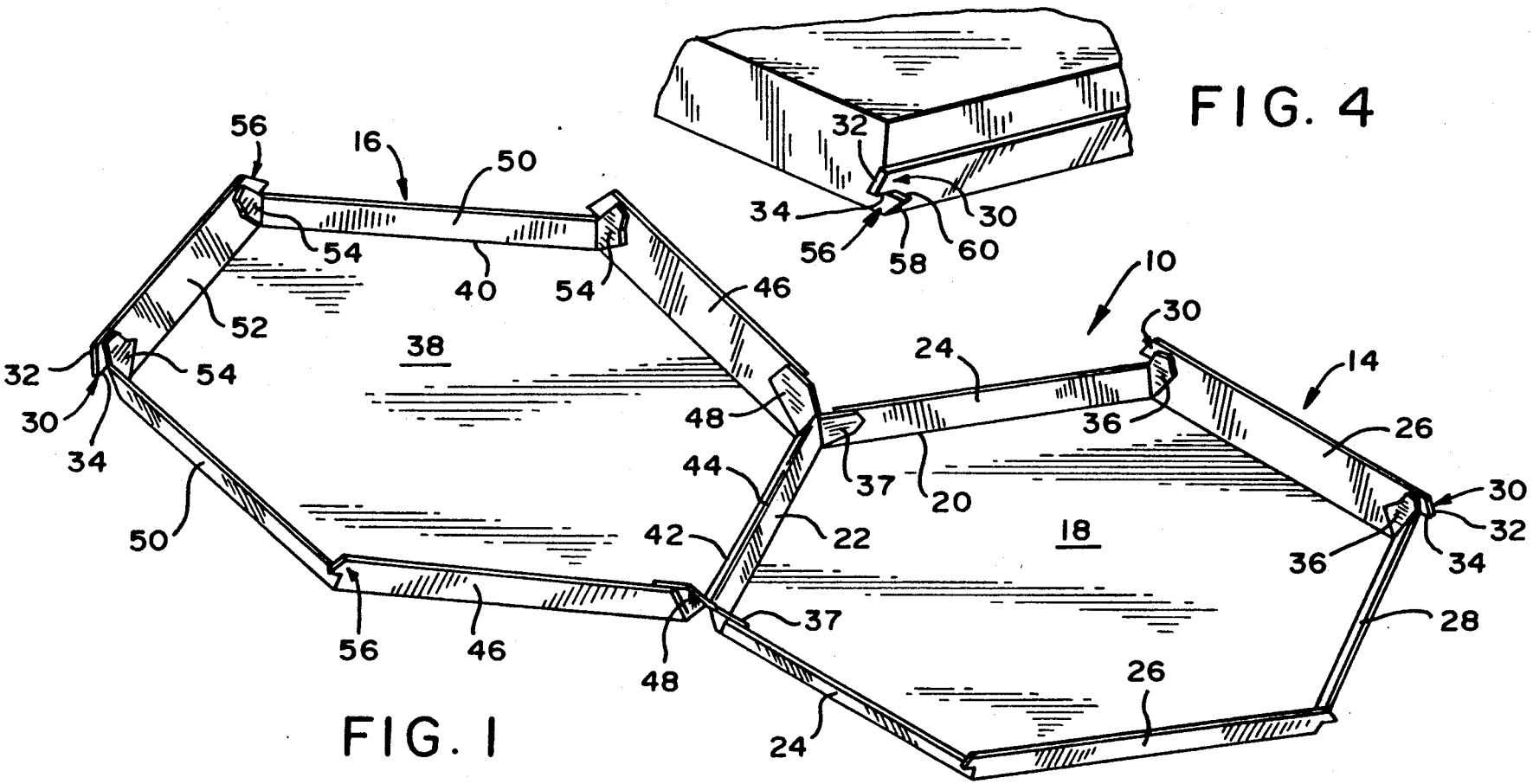
FIG. 1 is a perspective view of the open carton of the invention with the hinge joined tray and cover components folded from a unitary blank.
FIG. 4 is an enlarged corner detail of the closed carton.

Referring now more specifically to the drawings, the carton or box 10, in the preferred embodiment folded from a unitary blank 12 as illustrated in the drawings, includes two components 14 and 16. These components basically comprise a tray and a cover. While the components can interchangeably be used as the tray or cover, for purposes of illustration and this description, component 14 will be referred to as the tray and component 16 as the cover.

The tray 14 includes a base panel 18 of hexagonal configuration with six equal length linear edges 20 defining six equally spaced interior angles of 120°.

Planar walls are integrally formed with the base panel 18 coextensive with and along the edges 20 and extend upwardly therefrom, flaring slightly outward and defining a continuous wall means about the tray 14. The walls comprise a rear or inner wall 22, first low side walls 24 extending at obtuse angles, from the opposed ends of the rear wall 22, second high side walls 26 joined to the outer ends of the low walls 24 and extending at similar obtuse angles therefrom, and an outer or forward low wall 28 joined to and extending transversely between the outer ends of the high side walls 26. This low outer wall 28, in the preferred hexagonal embodiment, parallels the inner wall 22.

Each of the high side walls 26 includes a coplanar tab 30 on each end thereof which overlies and intersects the adjacent end of the adjacent low wall, either 24 or 28, and extends therebeyond to define a locking lug. As the lug, in the illustrated embodiment, is defined solely by the tab 30, the lug will similarly be designated by reference numeral 30.

The difference in height between the low and high walls is basically the height of the lugs 30. Each lug, noting FIG. 4, includes an inclined or beveled upper edge 32 for facilitating an engagement of complementary lugs of the carton as shall be described subsequently, and a lower locking shoulder 34.

Each of the low walls 24, 28 includes glue flaps 36 integral with and extending beyond the opposed ends thereof. These glue flaps 36 are folded to overlie either the inner or outer faces of the adjacent end portions of the high walls 26 and are bonded thereto to join the walls and rigidify the construction. As illustrated, the glue flaps 36, when folded, extend for substantially the full height of the adjacent high wall portions immediately inward of the tab-formed locking lugs 30, thereby stabilizing the locking lugs while allowing for a sufficient degree of inherent flexibility to accommodate several repeated openings and closings of the carton. Should additional rigidity of the locking lugs be desired, the glue flaps can be so configured as to define, at each locking lug, a second tab parallel to the high wall tab for direct bonding thereto.

The rear or inner wall 22, which is of equal height with the adjacent low side walls 24, similarly includes integral glue flaps 37 thereon which overlie the inner or outer surfaces of the adjacent ends of the low walls 24 and are intimately bonded or otherwise affixed thereto. It will be noted that no locking lugs are defined at these corners.

The second or cover component 16 is similarly configured to overlie and cooperate with the tray 14, and includes a hexagonal base panel 38 with planar edge joined walls extending from the six edges 40 of the base panel 38 and inclining slightly outward relative thereto.

Figure 2:
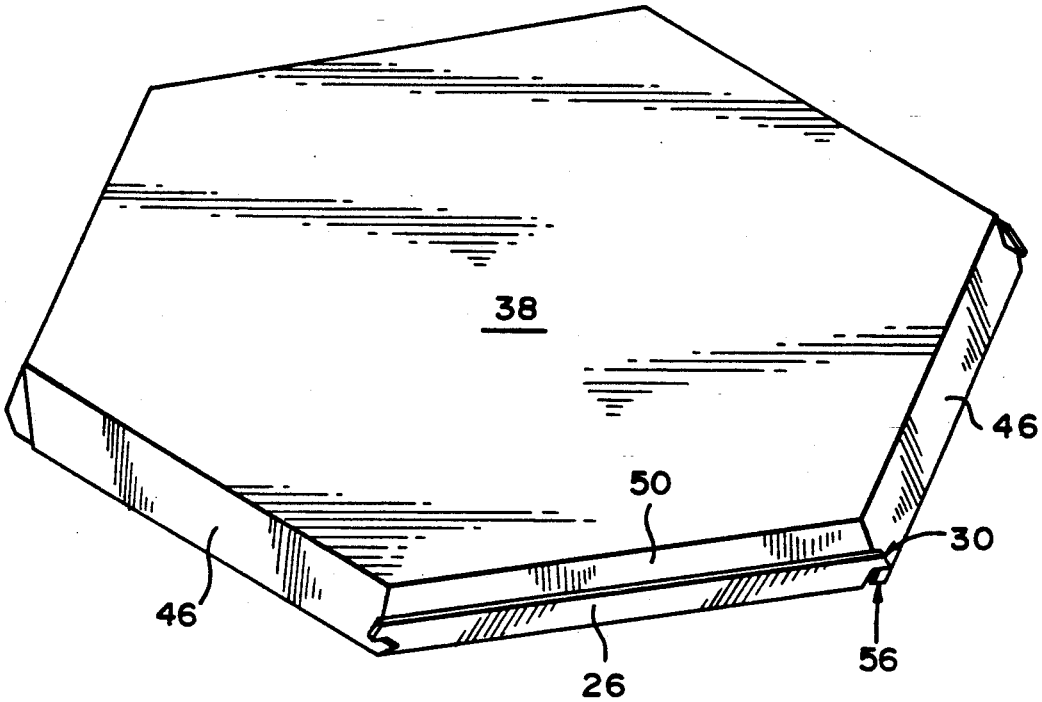
FIG. 2 is a perspective view of the closed carton illustrating the top, front and side thereof.
Figure 3:
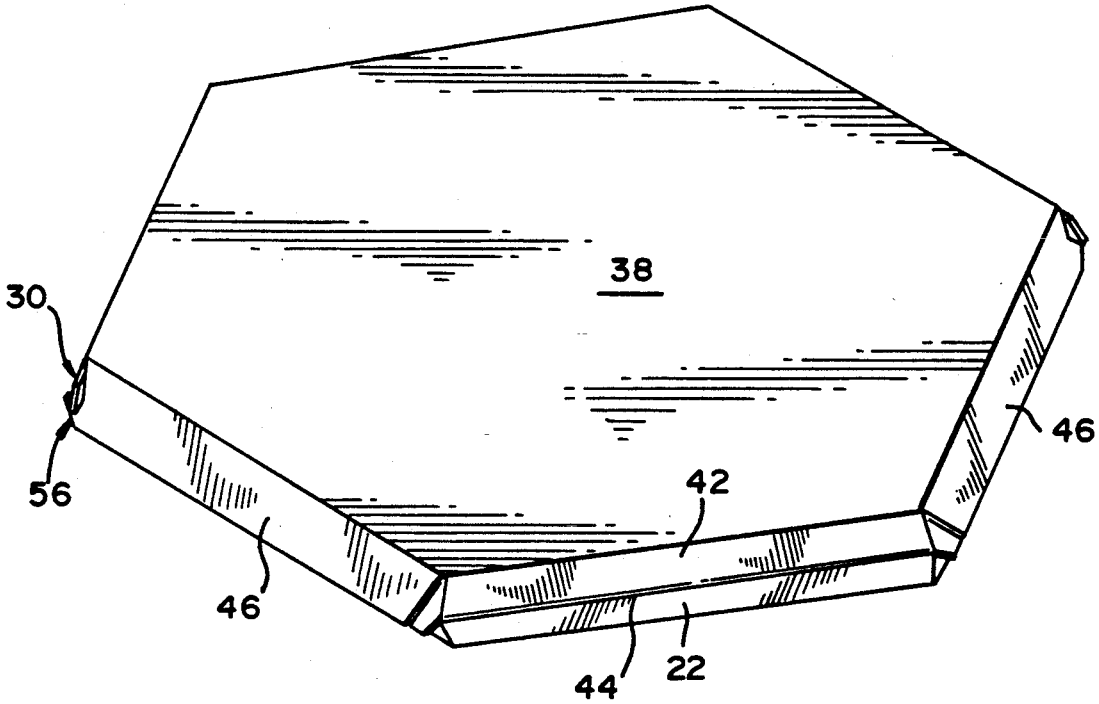
FIG. 3 is a perspective view of the closed carton taken from the rear and illustrating the hinge joinder between the tray and cover.

The walls of the cover 16 extend at 120° to each other, and include a low rear or inner wall 42 which is integrally joined for the full length of the upper edge thereto to the corresponding upper edge of the inner wall 22 of the tray 14 along a fold line 44 which defines a hinge allowing for a selective pivoting of the cover 16 between the open position of FIG. 1 and the closed position of FIGS. 2 and 3.

Two high side walls 46, joined to the opposed ends of the inner wall 42 by overlying glue flaps 48 folded from the opposed ends of the inner wall 42, extend forwardly. The outer ends of the high side walls 46 are in turn joined to forwardly extending low side walls 50. The outer ends of the low walls 50 are joined by a forward or outer high wall 52 extending therebetween and paralleling the low inner wall 42.

The two low walls 50 include integral glue flaps 54 on the opposed ends thereof which overlap and are affixed to either the inner or outer surfaces of the corresponding end portions of the high side walls 46 and high outer wall 52.

The opposed ends of the high outer wall 52, and the forward ends of the high side walls 46, those ends outward of the inner wall 42, are provided with integral coplanar projecting lug defining tabs 56 which overlie, intersect and extend beyond the adjoining ends of the low side walls 50. The difference in height between the high walls and low walls is substantially that of the height of the lugs 56. As desired, and as described with the tray flaps 36, the position of the corresponding glue flaps 54 tends to rigidify and stabilize the lugs 56, and can further enhance the strength of the lugs by extending substantially coextensive therewith and being directly bonded thereto.

With reference particularly to FIG. 4, the lugs 56, similar to lugs 30, include inclined or beveled outer edges 58 and inner locking shoulders 60.

As will be appreciated from the drawings, upon a closing of the carton cover 16 over the tray 14, each high wall of both the tray and cover will outwardly overlie a corresponding low wall with the automatic alignment of the walls as they close on each other being assured by the slight outwardly inclined formation thereto, the higher side walls inherently having the outer edges thereof outward of the outer edges of the low walls. As the walls are moved into engagement with each other, the corresponding projecting tray and cover locking lugs 30 and 56, through the beveled outer edges 32 and 60 thereof, engage and slide past each other, such being allowed by the inherent flexibly resilient nature of the material of the carton. Subsequent to a passage of the corresponding or cooperating lugs past each other, a snap interlocking of the lugs with the straight inner shoulders thereof engaged will prevent accidental disengagement. When so closed, while the carton can subsequently be readily opened, such an opening of the carton requires a specific manual manipulation thereof, thus ensuring a proper interlock and a retention of the carton closure against inadvertent opening. Disengagement of the cover from the tray will, in an obvious manner, require a slight flexing of one or more of the high walls, usually the forward high wall 52 of the cover 16.

As will be recognized, upon a closure of the cover 16 over the tray 14, the walls, other than for the permanently joined hinged inner walls 22 and 42, will overlap peripherally about the carton a distance equal to the difference in height between the low and high walls, thus providing for an effective sealing of the interior of the carton for heat retention and the like as well as an enhanced degree of peripheral rigidity.

With regard to the closed and sealed carton, it will be appreciated that the external positioning of the locking lugs provides a positive and immediate visual indication of a locking of the cover to the tray. Further, there are no openings, slots or the like through the carton walls as heretofore required by more conventional lock means.

Figure 5:
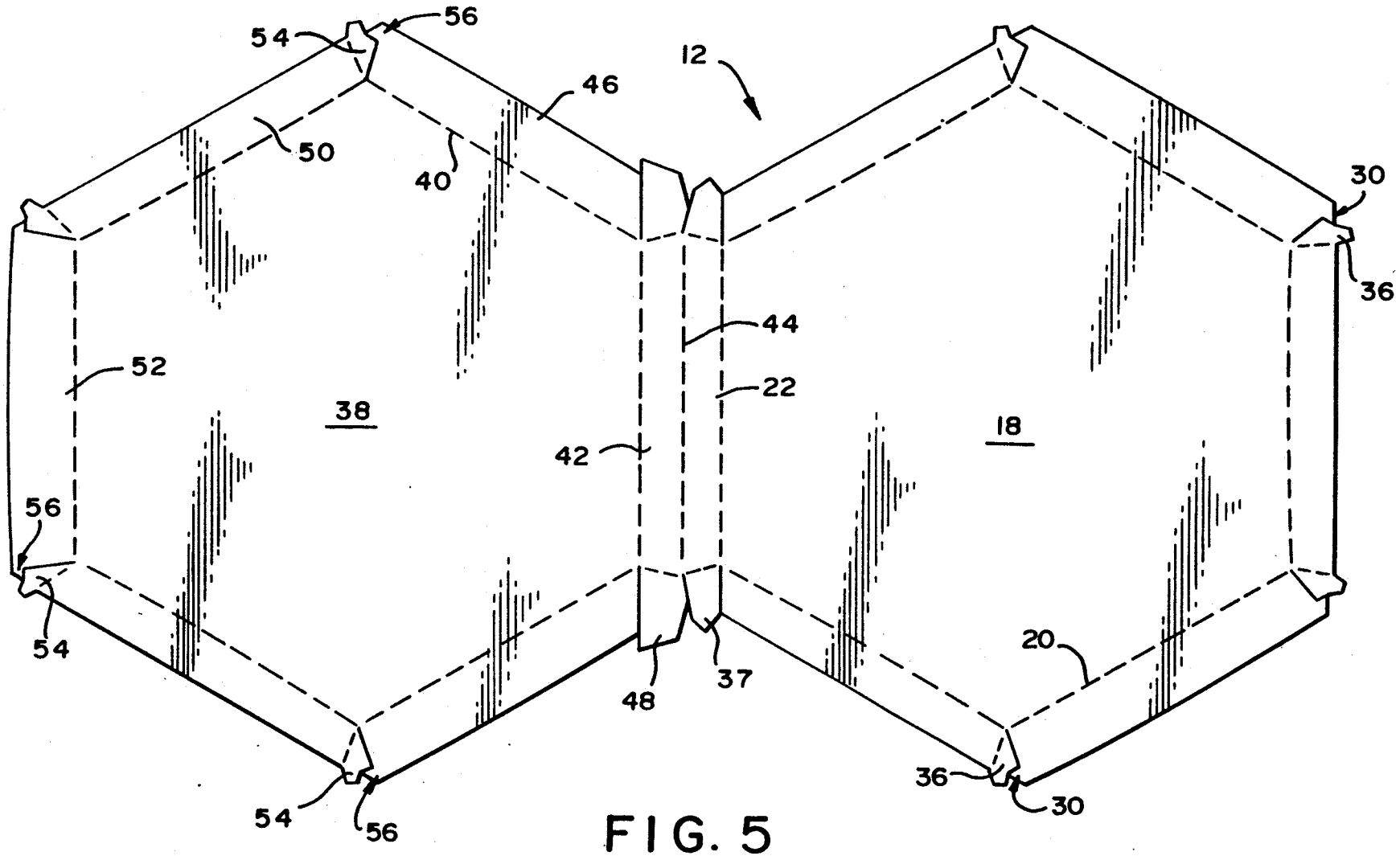
FIG. 5 is a plan view of the unitary blank from which the carton is folded.

As previously noted, the carton is preferably folded from a unitary blank of paperboard or the like. The blank 12 is illustrated in FIG. 5 wherein the components of the carton have been designated by like reference numerals for purposes of illustration and comparison.

Briefly, the base panels 18 and 38 are integrally joined along fold liens to the inner low walls 22 and 42 which are in turn integrally joined along the hinge forming fold line 44. Each of the remaining walls is similarly integrally joined along the corresponding edges of the associated base panels by fold lines. The glue flaps integral with and foldable from the opposed ends of the low walls, including the inner walls 22 and 42, are of a height so as to, when overlying the adjacent walls in the folded carton, extend for substantially the full height thereof.

While the preferred embodiment of carton or pizza box is hexagonal with equal sides, and folded from a unitary sheet of paperboard as above described, other polygonal configurations, wherein most or all of the walls extend at obtuse angles to each other to define a generally circular configuration may also be feasible. Similarly, materials other than paperboard might also be sued.

Basically, the preferred embodiment provides a pizza box which closely conforms to the conventional circular configuration of a pizza to minimize material and reduce excess interior space, thus achieving advantages inherent thereto including enhanced heat-preserving capability and reduce material expense. In conjunction with the specific configuration of the pizza box, a primary purpose of the invention is the provision of exposed interengaging locks at multiple spaced points thereabout to ensure a proper closure and sealing of the carton, notwithstanding the other than the conventional square configuration thereof.

The foregoing is considered illustrative of the principles of the invention. As modifications and variations may occur to those skilled in the art, it is not desired to limit the invention to the exact construction shown and described. Rather, the invention is to only be limited by the scope of the claims following hereinafter.

I claim:

1. A carton comprising a tray and a cover, a hinge joining said cover to said tray for selective pivotal movement of said cover between an open position remote from said tray and closed position overlying and closing said tray; said tray and said cover each including a base panel with peripherally positioned generally planar walls joined to and projecting from the base panel, said walls of each of said tray and said cover defining a generally circular configuration and having adjacent joined ends defining corners at peripherally spaced points about the corresponding base panel, at least a majority of said corners defining obtuse angles, said peripheral walls of each of said tray and said cover including an inner wall, the inner walls of said tray and cover having upper edges joined along the length thereof and defining said hinge joining said tray and said cover, and a locking lug extending generally coplanar from one end of one of said walls at each of said adjacent joined ends at each defined corner other than at said inner walls, each said lug at a respective one of said adjacent joined ends intersecting and extending beyond a second one of said walls at a respective one of said adjacent joined ends, the lugs on said cover being oriented to cross and releasably interlock with the lugs on said tray in said closed position of said cover.

2. The carton of claim 1 wherein said peripherally positioned walls of each of said tray and said cover, outward of said inner walls, comprising alternating low and high walls, one of said lugs extending from each of said high wall ends which joins an adjacent one of said low wall ends.

3. The carton of claim 2 wherein said inner walls are of a height equal to that of said low walls, one of said tray and cover having a pair of said high walls extending from the ends of the inner wall thereof, the other of said tray and said cover having a pair of said low walls extending from the ends of the inner wall thereof whereby, in the closed position of said cover, the high and low walls of said cover align over the low and high walls respectively of said tray.

4. The carton of claim 3 wherein said peripherally positioned walls of each of said tray and said cover define similar hexagonal configurations.

5. The carton of claim 4 wherein the peripherally positioned walls of each of said tray and said cover are of equal length and wherein each of said defined corners forms an obtuse angle.

6. The carton of claim 5 wherein said tray and said cover are folded from a unitary blank of foldable material comprising a pair of similarly configured substantially hexagonal components integral along a common fold line therebetween, said common fold line defining said hinge joining said cover to said tray.

7. The carton of claim 1 wherein said peripherally positioned walls of each of said tray and said cover define similar hexagonal configurations.

8. The carton of claim 7 wherein the peripherally positioned walls of each of said tray and said cover are of equal length and wherein each of said defined corners forms an obtuse angle.

9. The carton of claim 8 wherein said tray and said cover are folded from a unitary blank of foldable material comprising a pair of similarly configured substantially hexagonal components integral along a common fold line therebetween, said common fold line defining said hinge joining said cover to said tray.

10. A carton comprising a tray and cover of complementary configuration for a selective closing of said tray by said cover, said tray comprising a bottom panel and six walls extending therefrom and defining a hexagonal configuration, said walls each having opposed ends, flap means joining each of said wall ends of each of said walls to the adjoining ends of other ones of said walls to define tray corners, selected ones of said tray corners having locking elements thereon, said cover comprising a top panel and six walls extending therefrom and defining a hexagonal configuration, said cover walls each having opposed ends, flap means joining each of said cover wall ends of each of said cover walls to the adjoining ends of other ones of said cover walls to define cover corners, selected ones of said cover corners having locking elements thereon, said cover being selectively positionable over said tray with said walls of said cover engaging said walls of said tray and with said locking elements of said cover releasably interlocked with said locking elements of said tray to define a close carton.

11. The carton of claim 10 wherein said walls of each of said cover and said tray include a rear wall, said rear walls each including an upper edge integrally joined to the upper edge of the other rear wall along a fold line defining a hinge therebetween and between said cover and said tray for pivotal movement of said cover between open and closed positions relative to said tray.

12. The carton of claim 11 wherein said locking elements of each of said tray and said cover each comprise a lug integral with a respective one of said walls and projecting across and beyond an adjacent one of the walls, the lugs of said tray interlocking with the lugs of said cover outward of the defined corners.

13. For use in the formation of a folded carton, a blank of foldable material comprising two substantially hexagonal base panels with linear edges, side wall panels integrally joined respectively to each of said base panel edges along fold lines defined therebetween, one of said side wall panels of one of said base panels being integrally joined to one of said said wall panels of a second one of said base panels along coextensive outer edges defined by a common fold line therebetween, said side wall panels of each of said base panels having adjacent ends meeting at obtuse angles about each of said base panels and defining corners, one of said adjacent ends at each of said corners including a glue flap adapted to overlie an adjacent one of said wall panels, and selected other of said adjacent ends including a projecting tab which, upon a folding of the side wall panels, defines a projecting locking lug.

* * * * *

UNITED STATES PATENT AND TRADEMARK OFFICE

CERTIFICATE OF CORRECTION

PATENT NO. : 5,249,736

DATED : October 5, 1993

INVENTOR(S) : Larry EISMAN

It is certified that error appears in the above-identified patent and that said Letters Patent is hereby corrected as shown below:

Column 8, line 34, "said said" should be --said side--.

Signed and Sealed this

Fifteenth Day of March, 1994

*Attest:*

*Attesting Officer*

BRUCE LEHMAN

*Commissioner of Patents and Trademarks*